US008647504B2

(12) United States Patent
Vogtner

(10) Patent No.: US 8,647,504 B2
(45) Date of Patent: Feb. 11, 2014

(54) FILTER AND FILTER HANDLE FOR USE IN WATER FILTRATION SYSTEMS

(75) Inventor: Zachary Vogtner, Atlanta, GA (US)

(73) Assignee: Custom Molded Products, Inc., Newman, GA (US)

( * ) Notice: Subject to any disclaimer, the term of this patent is extended or adjusted under 35 U.S.C. 154(b) by 334 days.

(21) Appl. No.: 13/152,125

(22) Filed: Jun. 2, 2011

(65) Prior Publication Data

US 2012/0305462 A1 Dec. 6, 2012

(51) Int. Cl.
*B01D 29/35* (2006.01)

(52) U.S. Cl.
USPC ..... 210/167.1; 210/237; 210/470

(58) Field of Classification Search
USPC ..... 210/167.1, 167.19, 232, 237, 238, 448, 210/470, 471
See application file for complete search history.

(56) References Cited

U.S. PATENT DOCUMENTS

| | | | | |
|---|---|---|---|---|
| 2,890,796 | A * | 6/1959 | Blood | 210/470 |
| 3,650,405 | A * | 3/1972 | Morrison | 210/241 |
| 5,422,001 | A * | 6/1995 | Yagoda et al. | 210/238 |
| 5,595,095 | A * | 1/1997 | Hillinger | 81/58.3 |
| 5,705,058 | A * | 1/1998 | Fischer | 210/237 |
| 5,830,350 | A * | 11/1998 | Voss et al. | 210/167.12 |
| 5,918,535 | A * | 7/1999 | Moreau | 99/413 |
| 6,280,620 | B1 * | 8/2001 | Duran | 210/238 |
| 6,592,756 | B1 * | 7/2003 | Felix et al. | 210/167.12 |
| 2008/0083442 | A1 * | 4/2008 | Sherman | 135/65 |

* cited by examiner

*Primary Examiner* — Fred Prince
(74) *Attorney, Agent, or Firm* — Laurence P. Colton; Smith Risley Tempel Santos LLC

(57) ABSTRACT

A filter to remove debris from a pool, the filter including a basket defined by a bottom and a side wall, the side wall including a plurality of first apertures; and a handle with first and second ends, the first end of the handle connected to the side wall, in which the first end of the handle includes an opening in communication with the first apertures in the side wall, and the handle further includes a hollow neck disposed between the first and second ends, the neck including a plurality of second apertures.

17 Claims, 5 Drawing Sheets

FILTER AND FILTER HANDLE FOR USE IN WATER FILTRATION SYSTEMS

BACKGROUND OF THE INVENTION

1. Technical Field

This invention relates to filtration devices, and more particularly to swimming pool, spa, or hot tub filtration devices.

2. Prior Art

Most swimming pools have circulation and filtration systems. One purpose of such circulation and filtration systems is to capture and remove insects, frogs, leaves, and/or other debris floating on the surface of the water in the swimming pool. A common and generally effective way of achieving this purpose is the use of a skimmer passage and well formed in a side wall of the pool. A pump draws water from the surface of the pool, into the skimmer passage, and through a filter where the debris is separated from the pool water.

A popular filter for such systems is a skimmer basket designed to fit into the skimmer well, with openings to allow water to flow through the skimmer basket while the basket retains the debris. In order to remain effective, the skimmer basket must be periodically removed from the skimmer well so that the debris may be cleaned from the skimmer basket. To assist with removal of the skimmer basket, access to the skimmer passage and well is typically provided by an opening in the surface of the pool deck. The opening is typically covered for safety reasons when the skimmer basket is in use, and the cover may be removed to allow access to the skimmer basket for cleaning. In order to remove the skimmer basket for cleaning, the cleaner must insert his hand into the debris filled water in the skimmer basket feeling around for a handle, or grasp the skimmer basket at the top edge or rim. This can be unappealing given the variety of bugs, frogs, debris, etc. that can accumulate in a skimmer basket.

Additionally, when the openings in the skimmer basket are clogged with debris, it can be difficult to remove the skimmer basket. For example, when the openings in the skimmer basket are clogged, air and water cannot easily flow through the skimmer basket to relieve or vent the pressure from the suction of the water recirculating pump when removing the skimmer basket.

Accordingly, there is a need for a device that provides for easier and more sanitary removal of skimmer baskets from skimmer wells. It is to this need and others that the present invention is directed.

BRIEF SUMMARY OF THE INVENTION

A filter and handle for use in filtering systems are disclosed. An exemplary filter to remove debris from a swimming pool comprises a basket defined by a bottom and at least one side wall. The basket is configured with a plurality of first apertures in the at least one side wall. The filter comprises a handle with first and second ends. The first end of the handle is connected to the side wall of the basket such that an opening in the first end of the handle is in communication with at least one of the first apertures in the side wall of the basket. The handle of the exemplary filter further includes a hollow neck disposed between the first and second ends, the neck including a plurality of second apertures. The term pool and swimming pool as used herein includes all such artificial bodies of water, including but not limited to spas, hot tubs, fountains, and ponds.

Also disclosed is an exemplary handle for use with a filtration system configured to remove debris from a body of water. The exemplary handle comprises a first end and a second end where the first end includes a frame defining an opening. The frame of the first end of the handle is configured to connect to a filter basket containing apertures such that the opening of the first end is in communication with at least one of apertures of the filter basket. The handle further comprises a neck disposed between the first end and second end. The neck includes a second aperture and the neck is configured to allow a fluid to pass into the neck though the second aperture and out of the opening at the first end when the basket is removed from the filtration system. This handle can be securely or releasably attached to the side wall of the basket.

The configuration of the handle allows water to flow through the handle and out of the first aperture even if the side wall is covered in debris, such that the openings in the skimmer basket are clogged, making it easier to remove the basket from the skimmer well. The handle can be configured to extend upwards above the upper rim of the basket to a height above the water line of the pool, which allows air also to flow through the handle and out of the first aperture even if the side wall is covered in debris, such that the openings in the skimmer basket are clogged, also making it easier to remove the basket from the skimmer well. In use, the handle can be attached to the side wall to lift the basket out of the skimmer well such that the user need not reach into the basket. After emptying the basket of debris, the basket can be replaced in the skimmer well and, in the releasable handle embodiment, the handle can be removed and stored elsewhere.

These features, and other features and advantages of the present invention will become more apparent to those of ordinary skill in the relevant art when the following detailed description of the preferred embodiments is read in conjunction with the appended drawings.

BRIEF DESCRIPTION OF THE DRAWINGS

In the figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION OF PREFERRED EMBODIMENTS

Figure 1:
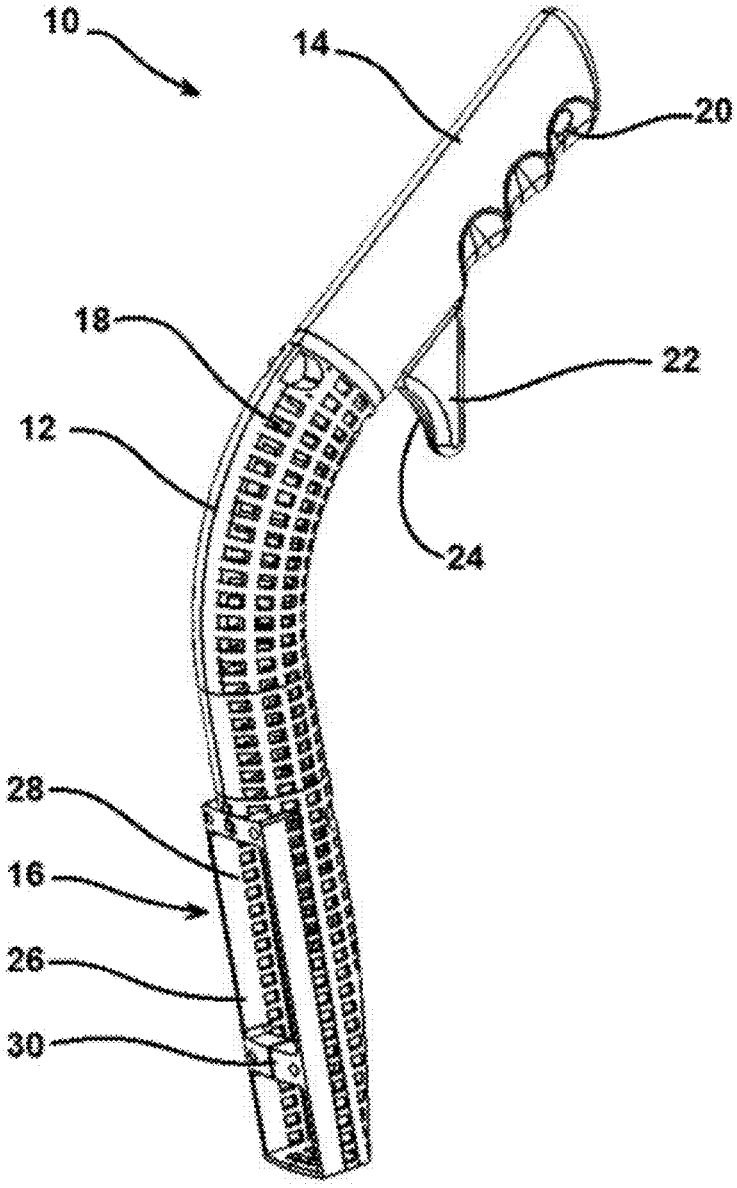
FIG. 1 is a perspective view of an exemplary embodiment of a filter basket handle.

FIG. 1 is a perspective view illustrating an exemplary embodiment of a handle 10 for use with filter baskets such as skimmer baskets. The exemplary handle 10 comprises an elongated neck 12 with a grip 14 connected to one end of the neck 12, and an attachment portion 16 connected to the opposite end of the neck 12 from the grip 14.

In the exemplary embodiment illustrated in FIG. 1, the neck 12 comprises a substantially cylindrical hollow tube with a circular cross-section and is made of plastic. However, the neck 12 may be a hollow or partially hollow tube of any desired cross-section shape (i.e. square cross-section, oval cross-section, triangular cross-section, etc.). Additionally, the neck 12 may be made of any material that is suitable for use in pool water. The wall of the neck 12 forming the tube may be any desired thickness that will allow the handle 10 to be operated to remove a basket from a filtration system (e.g. removing a skimmer basket from a skimmer well) as discussed below. In some embodiments, the thickness of the wall of the neck 12 may depend on the material used to make the neck 12.

The exemplary neck 12 is also configured with a plurality of apertures 18 that extend through the wall of the tube of the neck 12, forming openings through which air or water may flow into and/or out of the interior of the tube that comprises the neck 12. In manufacture, the neck 12 may be comprised of two halves that are connected in some fashion, such as by glue, screws, thermoforming, welding, etc., to form the tube. In other embodiments, the neck 12 may be cast or molded in a single piece to form a tube. Regardless of how the neck 12 is manufactured, a grip 14 is connected to one end of the neck 12. In the illustrative embodiment shown in FIG. 1, the grip 14 is also substantially cylindrical in shape, corresponding to the shape of the neck 12. In other embodiments, the grip 14 may be a different shape, such as substantially oval, triangular, or square, and the overall shape of the grip 14 may not correspond to the shape of the neck 12.

The grip 14 also may be made of the same material as the neck 12 or may a different material if desired. Similarly, the grip 14 may also comprise a hollow tube, or may be solid as desired. The grip 14 may be manufactured along with the neck 12 to be part of a single piece connected by manufacture. Alternatively, the grip 14 may be manufactured separately and may be attached or connected to the neck 12 by a variety of known methods, such as glue, thermoforming, welding, screws or other fasteners, etc. Accordingly, if, for example, the grip 14 is manufactured along with the neck 12, the grip 14 and neck 12 may be comprised of two halves that are connected together in some fashion, such as by glue, thermoforming, welding, screws, etc., to form the grip 14 and the neck 12.

The grip 14 illustrated in FIG. 1 also includes optional grooves 20 or indentions into the surface of the grip 14. The grooves 20 may be included to provide indentions into which a user's fingers may rest to help reduce slipping when a user grasps the grip 14 to remove a basket from a filtration system (e.g. removing a skimmer basket from a skimmer well) as discussed below. Similarly, the grip 14 illustrated in FIG. 1 also includes an optional trigger portion 22. The trigger portion 22 is illustrated in FIG. 1 extending from the bottom surface of the grip 14 and may provide an additional surface which a user's finger may wrap around when grasping the grip 14 to operate the filter basket handle 10. To that end, the trigger portion 22 may also include a trigger groove 24 or indention in the front surface of the trigger portion 22 as illustrated in FIG. 1, to allow for an even more secure grasp by the user. Such grasp-enhancing features of the grip 14 illustrated in FIG. 1, or other similar features such as hatching on the surface of the grip 14, coating portions of the surface of the grip 14 with a non-slip material, etc., may be advantageous for the operation of the filter basket handle 10 which is intended to be used in a wet environment, e.g. a pool.

At the opposite end of the neck 12 from the grip 14 is an attachment portion 16. The attachment portion 16 of the exemplary handle 10 is configured to allow the handle 10 to be attached to a filter basket such as a skimmer basket used with a pool. The attachment portion 16 of the exemplary handle 10 illustrated in FIG. 1 includes a substantially rigid frame 26 defining an opening 28 that is configured to be attached to the inside surface of a side of a filter basket (see FIG. 4). The frame 26 of the attachment portion 16 may be attached to a filter basket by screws, glue, or any other desired method. Alternatively, the frame 26 can be configured to cooperate with an attachment means (not shown) formed on the basket such that the handle can be releasably secured to the basket, and attached to the basket only when needed. Further, in the exemplary embodiment, the opening 28 defined by the frame 26 is configured such that when the handle 10 is attached to a filter basket (see FIG. 4), the opening 28 is disposed against inside surface of a side of the filter basket. In this manner, the opening 28 and the portion of the filter basket against which the opening 28 is disposed cannot become clogged or covered with debris during the filtering process.

In the embodiment illustrated in FIG. 1, the frame 26 of the attachment portion 16 defines a substantially rectangular opening 28 and the frame 26 is formed directly onto the neck 12 of the handle 10, comprising the same material as the neck 12. In other embodiments, the frame 26 of the attachment portion 16 may define openings of a different shape, such as square, circular, oval, triangular, and may be formed separately from the neck 12 and attached to the neck 12 by screws, glue, etc. Similarly, in some embodiments, the frame 26 may be made of a different material than the material that comprises the neck 12. The frame 26 illustrated in FIG. 1 also defines two separate rectangular openings 28 and the frame 26 includes a cross-piece 30 that serves to more securely fasten the handle 10 to a filter basket, and also to provide additional structural support for the handle 10. In other embodiments the frame 26 may be configured without the cross-piece 30 or with more than one cross-piece 30 as desired.

Figure 2:
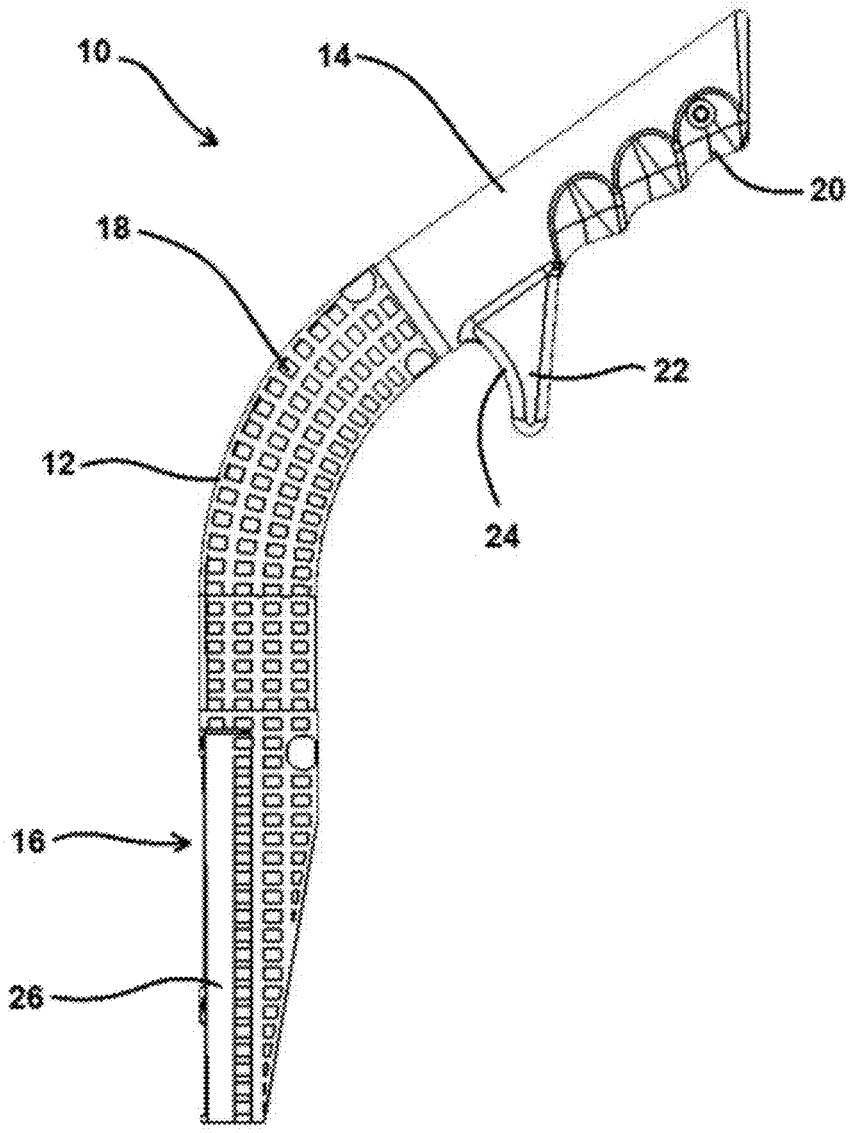
FIG. 2 is a side view of the exemplary embodiment of the filter basket handle illustrated in FIG. 1.

FIG. 2 is a side view of the exemplary handle 10 illustrated in FIG. 1. As shown more clearly in FIG. 2, the apertures 18 in the exemplary embodiment are substantially square in shape and are located in a substantially symmetric pattern over the side of the neck 12 and side of the attachment portion 16. In other embodiments, the apertures 18 could be other shapes such as circular, oval, triangular, etc. Similarly, in some embodiments, the apertures 18 may be larger or smaller than those illustrated in FIG. 2, and/or may be located on/through the neck 12 or attachment portion 16 in other locations or in other patterns than the apertures 18 shown in FIG. 2. For example, the apertures 18 may be irregularly placed on/through the neck 12 and attachment portion 16 so as not to form any pattern, or the apertures 18 may be placed on the front or rear of the neck 12 in addition to (or instead of) the side of the neck 12 and attachment portion 16 as illustrated in FIG. 2.

The neck 12 is also illustrated as curving from the grip 14 to the attachment portion 16 in an arc. In other embodiments, the neck 12 may be more or less curved than illustrated in FIG. 2, and the amount of curvature may depend at least in part on the shape of the filter basket or skimmer basket with which the handle 10 will be used. In yet other embodiments, the neck 12 may not curve at all, or the neck 12 may be angled instead of curved (not shown).

Figure 3:
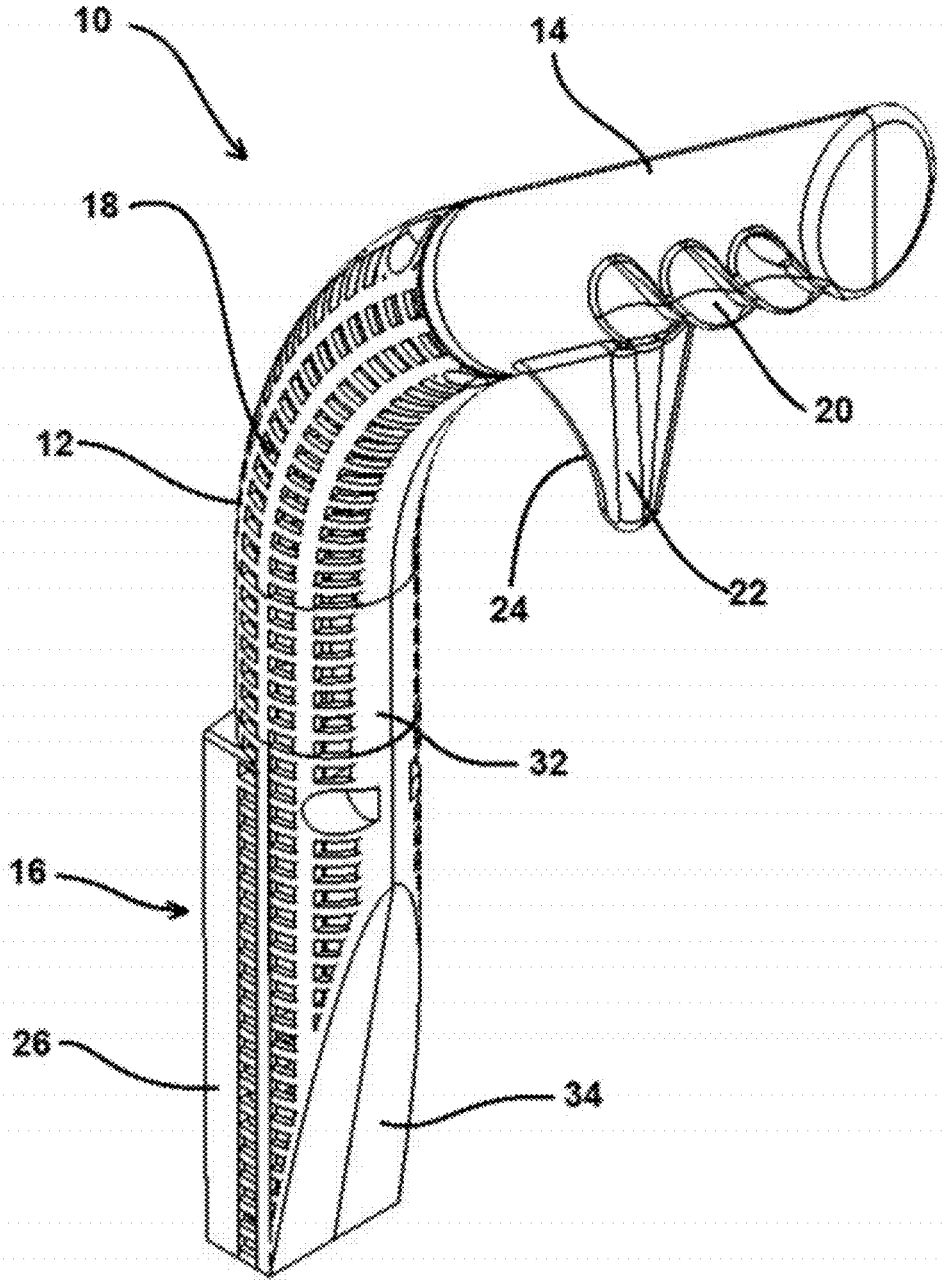
FIG. 3 is a rear perspective view of the exemplary embodiment of the filter basket handle illustrated in FIGS. 1 and 2.

FIG. 3 is a rear perspective view of the handle illustrated in FIGS. 1 and 2. As illustrated in FIG. 3, the neck 12 has a rear surface 32 which is substantially solid (i.e., does not contain apertures 18). The rear surface 32 of the neck 12 of the exemplary embodiment is solid to add structural strength and rigidity to the handle 10 when it is operated by the user. The back 34 of the attachment portion 16 shown in FIG. 3 is also illustrated as substantially solid and may optionally be angled. The back 34 of the illustrated attachment portion 16 is solid for similar reasons of structural strength and rigidity where the handle 10 is attached to a filter basket (see FIG. 4). The back 34 of the attachment portion 16 may also optionally be angled as illustrated in FIG. 3.

Figure 4:
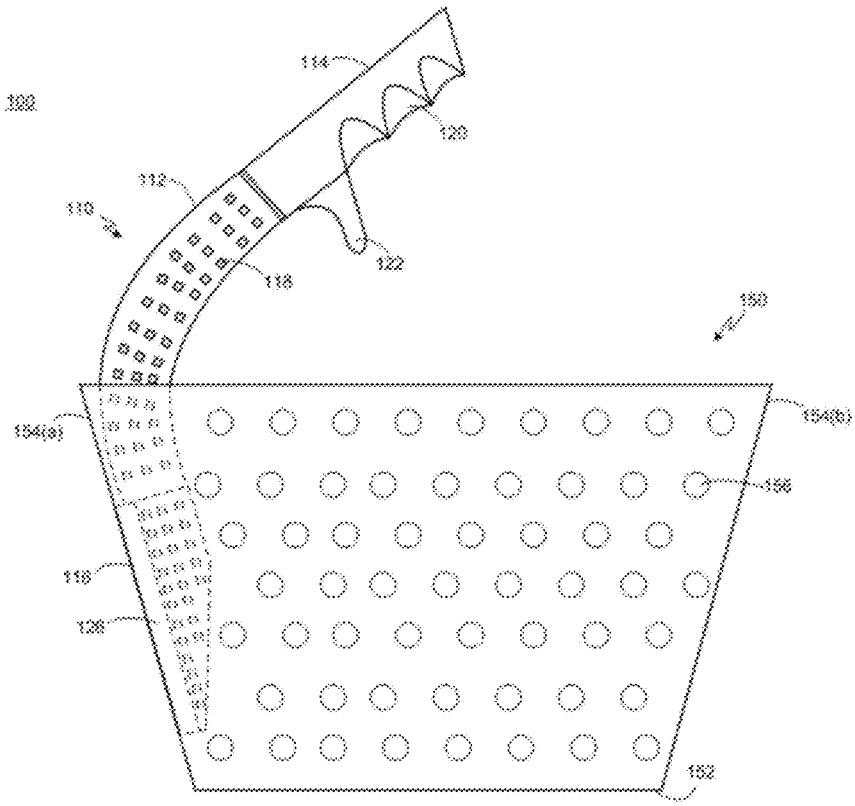
FIG. 4 is a side view of an exemplary embodiment of a filter basket system.
Figure 5:
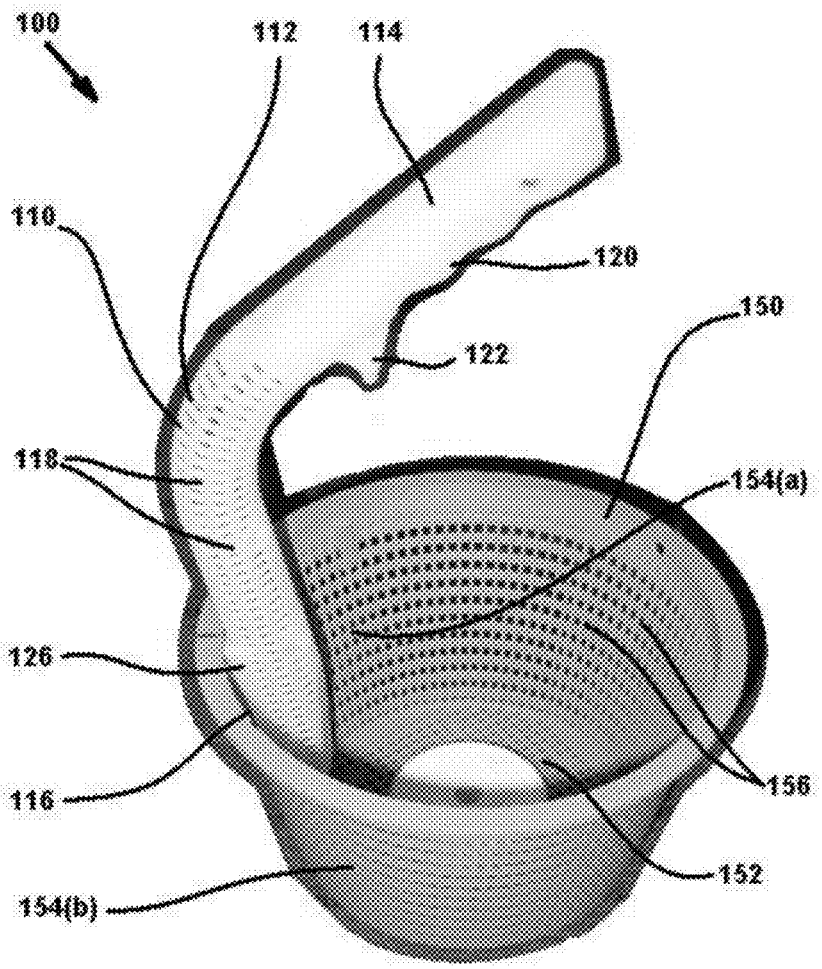
FIG. 5 is a perspective view of the exemplary embodiment of the filter basket system illustrated in FIG. 4.

FIG. 4 shows a side view of an embodiment of a filter basket system 100, comprising a handle 110 attached to a basket 150. Similar to the embodiment of the handle 10 described above, the handle 110 illustrated in FIG. 4 includes a neck 112 with a grip 114 connected to one end of the neck 112 and an attachment portion 116 connected to the end of the neck 112 opposite the grip 114. As discussed above with respect to FIG. 1, the exemplary grip 114 of FIG. 4 also includes grooves 120 and a trigger portion 122 to enable a user to more securely grasp the handle 110 when operating the filter basket system 100. FIG. 5 is a perspective view of this exemplary filter basket system 100

The neck 112 of the illustrated handle 110 forms a hollow tube with a substantially circular cross-section, but as discussed above, different cross-sections may be used, including oval, square, rectangular, triangular, etc. The neck 112 also includes a plurality of apertures 118 through the tube wall of the neck 112 to allow water and/or air to pass into or out of the interior of the neck 112 tube. The exemplary handle 110 also includes an attachment portion 116 comprising a frame 126 defining a substantially rectangular opening 128 (not shown).

The filter basket system 100 also is comprised of a basket 150, which is illustrated as a plastic skimmer basket, although other types of filter baskets and materials may also be used. The basket 150 illustrated in FIG. 4 includes a bottom 152 and sides 154(*a*), 154(*b*) and is open at the top. The sides 154 are connected to the bottom 152 and extend upwards therefrom at an angle such that the basket 150 is wider at the top than at the bottom 152. The basket 150 illustrated in FIG. 4 has a substantially circular cross-section, and is generally frustoconical in shape, although other cross-section shapes may be used if desired. Additionally, the exemplary basket 150 is dimensioned so as to fit into a skimmer well in a typical swimming pool, but may be any suitable size and/or thickness depending on the particular application (i.e. a commercial swimming pool, a residential swimming pool, a personal hot tub, a commercial hot tub, etc.).

The surfaces of the basket 150, including the bottom 152, include filter apertures 156 designed to allow water to flow into and out of the basket 150. The filter apertures 156 are dimensioned and configured so as to block debris floating on the surface of a swimming pool within the basket 150, while allowing water to flow out of the basket 150, thus capturing the debris. Although illustrated as generally round, the filter apertures 156 may be any shape, including square, triangular, oval, or other desired shape. Additionally, the filter apertures 156 may be dimensioned or arranged as illustrated in FIG. 4, or may be arranged in another pattern if desired, or may be arranged randomly and not in any pattern. The basket 150 may be constructed of plastic or any other material suitable for use in an environment such as a swimming pool. In some embodiments, the basket 150 may be made of the same material as part, or all, of the handle 110, while in other embodiments the basket 150 may be made of a different material (or different thickness of material) than some, or all, of the handle 110.

As illustrated in FIG. 4, to form the filter basket system 100, the handle 110 is connected to one of the side walls 154 of the basket 150. In the exemplary embodiment, the frame 126 of the attachment portion 116 of the handle 110 is connected to an inside surface of the side wall 154(*a*) of the basket 150, although other configurations are possible. The exemplary handle 110 is dimensioned and located so as to extend above the top of the basket 150 and the water line of the pool, but preferably not protrude above the upper surface of a pool deck with which the filter basket system 100 may be used. For example, the filter basket system 100 may be a skimmer basket 150 and handle 110 used with a residential pool filtration system. In such an embodiment, the exemplary handle 110 may be left attached to the basket 150 while the basket 150 is in use filtering debris from the pool, but at the same time, the handle 110 preferably does not protrude out of the skimmer well above the surface of the pool deck so as to present a tripping hazard.

As indicated above, the neck 112 of the exemplary handle 110 is curved so as to allow the grip 114 to extend away from the sidewall 154(*a*) of the basket 150 and above the top of the basket 150, while still preventing the handle 110 protruding above the upper surface of a pool deck with which the filter basket system 100 may be used. The dimensions of the handle 110, including the radius of curvature of the neck 112 may vary as desired, and may depend in part on how angled the sidewalls 154 of the basket 150 are in relation to the bottom 152 of the basket 150. In this manner, the handle 110 allows for secure grasping, removing and cleaning of the basket 150 without the need to feel around for the basket 150 itself or to submerge the user's hand into the debris filled basket 150.

The design and location of the exemplary handle 110 also allows for the basket 150 to be more easily removed when debris is clogging all, or most, of the filter apertures 156 of the basket 150. When a basket 150 has operated properly to remove debris from a pool and a substantial portion of, or all, of the filter apertures 156 are covered with debris, the basket 150 can become filled with water. As the water can no longer easily exit through the filter apertures 156, the water is retained in the basket 150 when it is removed, adding substantially to the weight of the basket 150. Additionally, the suction from the water recirculating system pump (not shown) pulling water into the basket 150 from the pool can be greatly increased when water or air can no longer easily vent from the basket 150 through the filter apertures 156, also increasing the amount of force required to remove the basket 150 filled with debris.

The design and location of the exemplary handle 110 alleviates these problems. When attached to the basket 150 as illustrated in FIG. 4, the opening 128 defined by the frame 126 of the attachment portion 116 of the handle 110 is in communication with one or more of the filter apertures 156 in the basket 150. In this manner, at least some of the filter apertures 156 remain unclogged and able to vent air or water when the basket 150 is removed from the filtration system by the handle 110, for example from a skimmer well. Additionally, as at least some of the apertures 118 in the neck 112 or attachment portion 116 of the handle 110 are above the water line, and therefore unclogged by debris, there will always apertures 118 free for air or water to flow into and out of the neck 112 (which is in the exemplary embodiment a substantially hollow tube) when the handle 110 is used to lift the basket 150.

For example, when the exemplary handle 110 of FIG. 4 is used to lift the basket 150 out of a skimmer well in a swimming pool filtration system, the unclogged apertures 118 in the neck 112 can allow air and/or water to flow into the interior of the neck 112, through the tube of the neck 112 to the attachment portion 116, out of the neck 112 through the opening 128 in the attachment portion 116, and out of the basket 150 through the filter apertures 156 that are in communication with the opening 128. This allows water otherwise trapped in and weighing down the basket 150 to vent out of the basket 150, and also allows air to vent out of the basket 150 and overcome the suction from the pump of the recirculating system against the basket 150 caused by the clogged filter apertures 156.

The present invention also helps prevent cavitation from occurring in the pump of the water recirculating system. If a typical filter basket becomes clogged with debris, there is the possibility that water will be prevented from circulating through the water circulating system. For example, the clogged basket could prevent water from being pulled through the skimmer well from the pool to the pump. This could cause cavitation in the pump. The present invention provides an additional pathway for water to pass through, that is through the handle 10, 110, which is less likely to become clogged with debris.

Although selected aspects of the exemplary handle 110, basket 150, and filter basket system 100 have been illustrated and described, it will be understood that various substitutions and alterations may be made therein without departing from the spirit and scope of the present invention. For example, the handle 110 could be dimensioned or located differently while still achieving the above-identified benefits. Similarly, the basket 150 could be dimensioned differently, or used in something other than a skimming well (or in applications other than a swimming pool) while achieving the above-identified benefits.

Moreover, it may be beneficial for some uses to have separate chambers within the tube of the neck 12, 112 for air flow and water flow and/or to locate and size the apertures 18, 118 to more specifically accommodate air flow or water flow within the neck 12, 112. Similarly, it may be beneficial for some uses to have more than one handle 110 attached to the basket 150 in the same, or in varying locations, including separate handles 110 or one handle 110 comprised of multiple necks 112 that connect to the basket 150 in different locations. These, as well as other understood substitutions and alterations are intended to be within the scope of the present invention as defined by the following claims.

In one alternative embodiment of the invention, the frame 26 can comprise a first attachment means (not shown) and the basket 150 can be manufactured with or retrofitted with a second attachment means (not shown) on the side wall. The first attachment means and the second attachment means can cooperate to releasably secure the handle 110 to the basket 150 in any of many known manners. In use, the basket 150 would remain in the skimmer well without the handle 110 during normal pool operation. When it is desired to remove the basket 150 from the skimmer well, the handle 11 can be attached to the basket 150 by connecting the first attachment means to the second attachment means and lifting the basket 150 out of the skimmer well. The handle 110 can be removed from the basket 150 at any time.

The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention

What is claimed is:

1. A filter to remove debris from a pool, the filter comprising:

a) a basket defined by a bottom and at least one side wall, the at least one side wall including a plurality of first apertures; and b) a handle with first and second ends, wherein the first end of the handle is releasably attached to an inside surface of the at least one side wall, wherein:

the first end of the handle includes an opening in communication with at least one of the plurality of first apertures in the at least one side wall, and the handle further includes a hollow neck disposed between the first and second ends, the neck including a plurality of second apertures that are in communication with one or more of the first apertures on the at least one side wall of the basket.

2. The filter of claim 1, wherein the basket is a skimmer basket for use in a skimmer well of a pool filtration system.

3. The filter of claim 1, wherein the second end of the handle includes a grip.

4. The filter of claim 3, wherein the grip extends above the top of the basket.

5. The filter of claim 1, wherein the first end of the handle further includes a frame defining the opening and the frame is releasably connected to the inside surface of the at least one side wall of the basket.

6. The filter of claim 2, wherein the plurality of second apertures are located in the hollow neck so as to allow a fluid to pass into the hollow neck and out of the opening in the first end of the handle when the basket is removed from the swimming pool filtration system.

7. The filter of claim 6, wherein the fluid is air.

8. The filter of claim 6, wherein the fluid is water.

9. A filter to remove debris from a pool, the filter comprising:

a) a basket defined by a bottom and at least one side wall, the at least one side wall including a plurality of first apertures; and b) a handle with first and second ends and a hollow neck disposed between the first and second ends, the first end of the handle having a frame that is releasably connected to an inside surface of the at least one side wall of the basket, wherein the frame defines an opening in communication with at least one of the plurality of first apertures in the at least one side wall of the basket, and wherein the hollow neck includes at least one second aperture that is in communication through the opening with the at least one of the plurality of first apertures in the at least one side wall of the basket, whereby the at least one second aperture is located in the hollow neck so as to allow a fluid to pass into the hollow neck through the at least one second aperture, out of the opening in the first end of the handle, and through the at least one of the plurality of first apertures in the at least one side wall of the basket.

10. A handle for use with a filtration system configured to remove debris from a body of water, the handle comprising:

a) a first end and a second end, the first end including a frame defining an opening, the frame configured to be releasably connected to an inside surface of a filter basket containing apertures such that the opening of the first end is in communication with at least one of the apertures of the filter basket; and b) a hollow neck disposed between the first end and second end, the hollow neck including at least one second aperture, the hollow neck configured to allow a fluid to pass into the hollow neck though the at least one second aperture and out of the opening at the first end when the basket is removed from the filtration system, whereby the at least one second aperture is located in the hollow neck so as to allow a fluid to pass into the hollow neck through the at least one second aperture, out of the opening in the first end of the handle, and through the at least one of the apertures in the filter basket.

11. The handle of claim 10, wherein the filter basket is a skimmer basket.

12. The handle of claim 10, wherein the fluid is air.

13. The handle of claim 10, wherein the fluid is water.

14. The handle of claim 10, wherein the second end includes a grip.

15. The handle of claim 14, wherein the grip extends above a top of the filter basket.

16. The handle of claim 15, wherein the neck is curved and dimensioned so as to extend the grip above the top of the filter basket.

17. The handle of claim 14, wherein the grip is configured with one of a trigger portion, finger grooves, a coating of non-slip material, or a non-slip pattern in the surface of the grip.

* * * * *